United States Patent [19]

Popplewell et al.

[11] 4,169,729

[45] Oct. 2, 1979

[54] CORROSION RESISTANT COPPER BASE ALLOYS FOR HEAT EXCHANGER TUBE

[75] Inventors: James M. Popplewell, Guilford; Constance F. Acton, Wallingford; Andrew J. Brock, Cheshire, all of Conn.

[73] Assignee: Olin Corporation, New Haven, Conn.

[21] Appl. No.: 879,135

[22] Filed: Feb. 21, 1978

[51] Int. Cl.[2] ..... C22C 9/02

[52] U.S. Cl. ..... 75/154; 75/159; 75/161

[58] Field of Search ..... 75/153, 154, 159, 161, 75/162; 148/11.5 C

[56] References Cited

U.S. PATENT DOCUMENTS

| | | | |
|---|---|---|---|
| 2,031,316 | 2/1936 | Jennison | 75/154 |
| 2,061,897 | 11/1936 | Crampton | 75/159 |
| 2,085,544 | 6/1937 | Price | 75/154 |

OTHER PUBLICATIONS

Vaders, "Corrosion, Particularly of Copper-Zinc Alloys by Sea Water and Chemical Solutions II", Metallwissenschaft und Technik, pp. 1210-1224, 1963.

*Primary Examiner*—L. Dewayne Rutledge
*Assistant Examiner*—Peter K. Skiff
*Attorney, Agent, or Firm*—Paul Weinstein

[57] ABSTRACT

An alloy system is disclosed which is particularly useful for heat exchanger and potable water tubing applications. This alloy system utilizes additions of nickel, tin and manganese in a copper base with the optional addition of aluminum. Such elements as arsenic, antimony and phosphorus may be added as parting inhibitors to this system.

5 Claims, 3 Drawing Figures

CORROSION RESISTANT COPPER BASE ALLOYS FOR HEAT EXCHANGER TUBE

BACKGROUND OF THE INVENTION

Copper base alloys have been extensively utilized in tubing for heat exchanger applications. These alloys, in particular the copper-nickel alloys, have found wide acceptance due to their good balance of corrosion resistance and mechanical properties. In particular, such alloys as Alloy 706 and 715 (containing, respectively, 10% and 30% nickel in a copper base) have found wide acceptance in surface condenser heat exchangers utilized by power generating plants. These alloys, although widely used, do present difficulties of their own. In particular, at least 10% nickel is usually necessary in the alloys to achieve good corrosion resistance. This tends to make the alloys quite expensive and therefore uncompetitive with certain other non-copper alloy systems. The initial corrosion rates for these copper-nickel alloys also tend to be quite high until a protective film has had a chance to form on the tubing surface made from such alloys. This high initial corrosion rate raises the possibility of copper being released to the environment and in particular to potable water flowing through tubes made from such alloys. The presence of ionic copper in industrial effluents is thought to be harmful to some aquatic species. Therefore, research has been done into various alloy systems to determine an alloy which reduces such copper release without being overly expensive.

Various alloy systems have been developed to overcome the high cost of the copper-nickel alloy systems. These alloy systems have generally not been able to provide the high corrosion resistance properties of the copper-nickel alloys in heat exchanger applications. Alloy systems have been developed for their corrosion resistance and strength properties which utilize varied alloy additions for such properties. For example, U.S. Pat. No. 3,937,638 utilizes various additions of nickel and tin to a copper base to provide increased strength and corrosion resistance properties. This patent also mentions that various other additions such as zinc, manganese, silicon, phosphorus, lead and chromium may also be added to the alloy system. This alloy system undergoes a specific working and heat treating operation to achieve these properties.

Another alloy system containing manganese, nickel and aluminum in a copper base and also tin, nickel and aluminum in a copper base is taught in "Properties of Some Temper-Hardening Copper Alloys Containing Additions of Nickel and Aluminium" in the *Journal of the Institute of Metals*, Volume 52, No. 3 (1933) on Pages 153 to 184. This particular article nowhere teaches that these alloy systems may be utilized for their corrosion resistance properties specifically in tubing applications. None of these references, either the U.S. patent or the article, disclose the particular alloy system and accompanying use which will be disclosed in the present specification.

Therefore, it is a principal object of the present invention to provide an alloy system which is highly resistant to corrosion without being high in cost.

It is a further object of the present invention to provide an alloy system as aforesaid which provides increased resistance to corrosion in potable and brackish water applications compared to commercially available corrosion resistant alloys.

It is a further object of the present invention to provide an alloy system as aforesaid which exhibits a low initial corrosion rate to minimize soluble copper release to the environment on start up of tubing systems.

It is yet a further object of the present invention to provide an alloy system as aforesaid which retains single phase properties within the alloy structure after processing to increase corrosion resistance properties.

Further objects and advantages of the present invention will become apparent from a consideration of the following specification.

SUMMARY OF THE INVENTION

The alloy system of the present invention fulfills these objects and advantages by utilizing alloying additions of nickel, tin and manganese in a copper base with the optional addition of aluminum. Further alloying elements such as arsenic, antimony and phosphorus may be included in the alloy system as inhibiting agents. This alloy system exhibits improved corrosion resistance in potable and brackish water conditions when compared to the widely used Alloy 706 (copper-10% nickel). This alloy system should be processed in such a manner as to maintain a single phase within the alloy structure since multiple phases within the structure have an inherently detrimental effect upon corrosion resistance performance.

DETAILED DESCRIPTION

The alloy system of the present invention incorporates the addition of various alloying elements in a copper base. In particular, these elements are 3.0 to 7.5% by weight nickel, 0.5 to 4.0% by weight tin, up to 4.0% by weight aluminum and 0.001 to 1.0% by weight manganese. From 0.01 to 2.0% by weight of an element selected from the group consisting of arsenic, antimony and phosphorus, or combinations thereof, may be added to the alloy system as a parting inhibitor.

Preferably, the alloy system of the present invention consists essentially of 4.0 to 6.0% by weight nickel, 2.0 to 3.0% by weight aluminum, 1.0 to 3.0% by weight tin, 0.1 to 0.5% by weight manganese, balance copper. The elements listed above as parting inhibitors may also be added, singly or in combination, to the preferred alloy system.

The processing of this alloy system follows conventional practice, provided that the alloy retain its single phase throughout all steps of the processing. The alloy system undergoes both hot and cold working to an initial reduction gauge, followed by annealing and cold working in cycles down to the final desired gauge.

The alloy of the present invention may be cast in any convenient manner such as Durville, direct chill or continuous casting. The alloy should be homogenized at a minimum temperature of 500° C. and a maximum temperature of 1050° C., or the solidus temperature, whichever is lower for the particular alloy, for at least 15 minutes. This homogenization is then followed by hot working of the alloy, for example by hot rolling, at a finishing temperature of at least 400° C. and preferably between 650° and 950° C. The alloy should be rapidly quenched, preferably using a water bath, after being hot worked in order to insure a solid solution microstructure within the alloy.

The alloy is then cold worked at a temperature below 200° C. with or without intermediate annealing depending upon the particular gauge requirements in the final strip material. In general, annealing may be performed using either strip or batch processing with holding times of from 10 seconds to 24 hours at temperatures ranging from 525° C. to 1050° C. or within 50° C. of the solidus temperature for the particular alloy, depending upon the particular alloy being processed. Following annealing, the alloy is rapidly quenched, preferably using a water bath, to retain a single phase microstructure.

The process of the present invention and the advantages obtained thereby may be more readily understood from a consideration of the following illustrative examples. All percentages for the alloying additions will be in terms of weight percent.

EXAMPLE I

Figure 1:
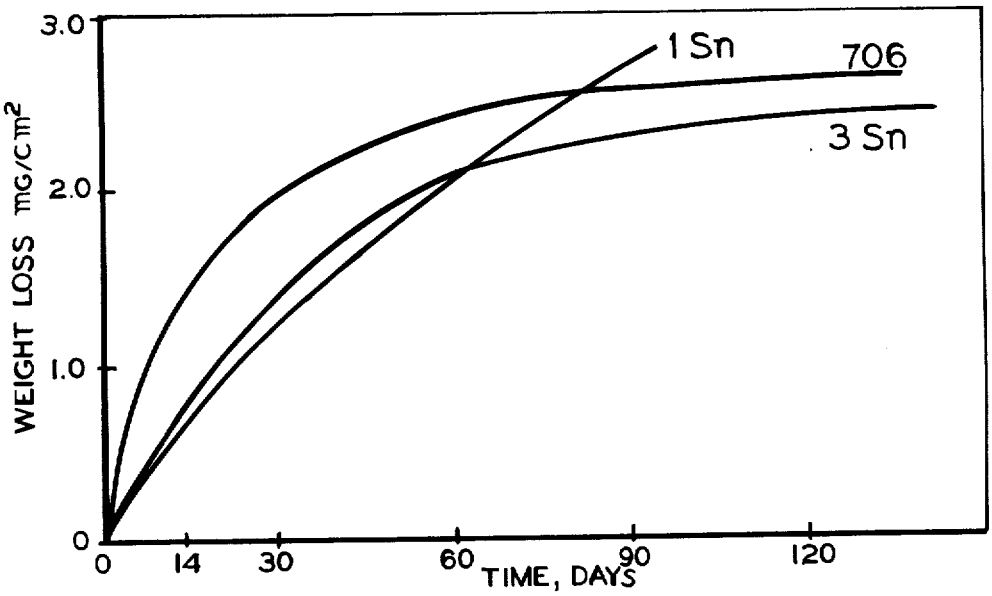
FIG. 1 is a graph comparing the weight loss in potable water performance of several versions of the alloy system of the present invention when compared to Alloy 706.

An alloy containing 4.99% Ni, 2.88% Sn, 0.16% Mn, balance Cu was cast as a Durville ingot and was hot and cold worked by conventional practice to a 0.120" gauge. The worked material was then annealed at 800° C. for 15 minutes, cold worked to a 0.060" gauge, final solution annealed at 800° C. for 10 minutes and finally cold worked to a 0.030" gauge. A sample from this material was tested along with Alloy 706 (both as strip material) for 90 days in New Haven, Connecticut potable water, which is an aggressive soft water known to be corrosive to copper base alloys. The Alloy 706 contained 10.06% Ni, 1.32% Fe, 0.13% Mn, balance Cu. The strips were placed in a trough through which the water flowed at 3 feet per second (fps). The temperature of the water was controlled at 40° C. and the water supply was replenished at the rate of 10% per hour, thus simulating a once-through flow system. Weight loss in milligrams per square centimeter of strip material was plotted against time in days for each alloy and the results are shown in FIG. 1. A similar test was run with a strip material having a composition containing 5.07% Ni, 1.98% Al, 0.91% Sn, 0.11% Mn, balance Cu, except that this material was annealed at 750° C. The results for the alloy containing 2.88% Sn are shown as "3 Sn" and the results for the alloy containing 0.91% Sn are shown as "1 Sn" on FIG. 1.

EXAMPLE II

Figure 2:
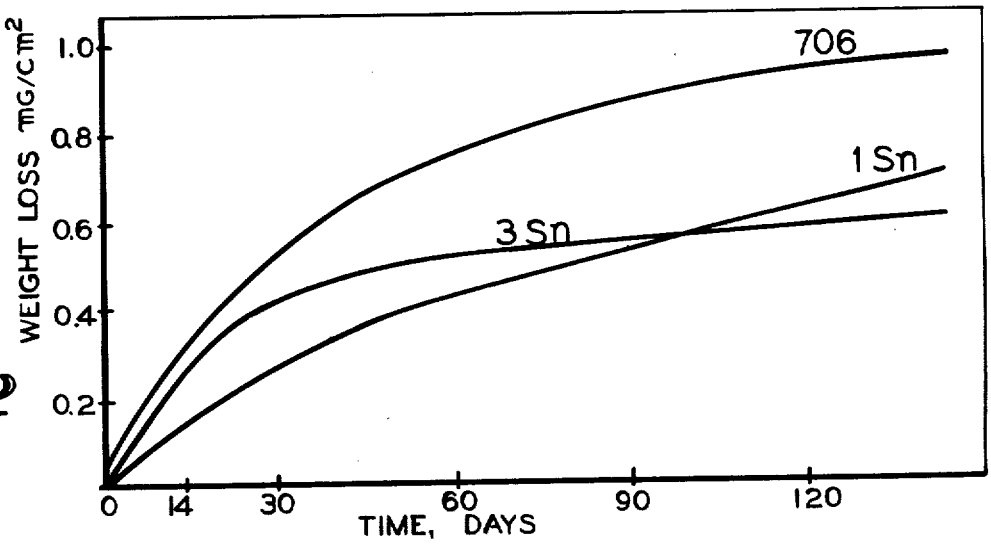
FIG. 2 is a graph comparing the weight loss in synthetic brackish water of several versions of the alloy system of the present invention when compared to Alloy 706.

The alloys of Example I were tested against Alloy 706 in a similar trough arrangement containing 0.1% by weight synthetic sea water formulatd from ASTM Standard Specification D1141-52. This solution was recirculated but not replenished. Although the material was not replenished during the testing, the solution was changed weekly throughout the duration of the test. This simulated brackish water conditions. The weight loss for each sample in milligrams per square centimeter was plotted against time in days and the results are shown in FIG. 2.

As can be seen from FIG. 1, both the initial and steady state corrosion rates for the 3 Sn alloy in potable water are only about half that of Alloy 706. The corrosion rate of the 1 Sn alloy at 90 days in potable water is essentially equivalent to Alloy 706 but the initial corrosion rate of this alloy is considerably less than that of Alloy 706. FIG. 2 shows that for synthetic brackish water conditions, the initial corrosion rate for both Alloy 706 and the 3 Sn alloy is nearly the same but the steady state corrosion rate for the 3 Sn alloy is lower than that for Alloy 706. FIG. 2 also demonstrates a reduced initial corrosion rate for the 1 Sn alloy in brackish water when compared to Alloy 706. It can be seen from FIG. 2, however, that the 90-day corrosion rate for the 1 Sn alloy is considerably lower than that for Alloy 706. After 90 days, FIG. 2 indicates that this alloy (1 Sn) has not yet reached a steady state corrosion rate. Therefore, its performance at steady state would be expected to be much better.

EXAMPLE III

Strips of the alloys utilized in Examples I and II, along with Alloy 706, were utilized in a spinning disc paddle wheel test in which samples of each alloy were rotated in the synthetic brackish water at 14 fps. The solution was recirculated with weekly replacement. This test was used to measure relative erosion corrosion performance for each alloy. Results for both a two week weight loss and observed localized corrosion for each alloy are shown in Table I.

TABLE I

CORROSION RATES AND LOCALIZED CORROSION OBSERVATIONS FOR PADDLE WHEEL TEST

| Alloy | Weight Loss mg/cm$^2$ | Crevice Corrosion, mils. |
|---|---|---|
| 706 | 1.78 | 1 |
| 3 Sn | 1.62 | 4 |
| 706 | 1.47 | 4 |
| 1 Sn | 1.24 | 5 |

It can be seen from Table I that the weight loss for the 3 Sn alloy was only 91% of the weight loss for Alloy 706. The performance of the 1 Sn alloy was even better, with only 84% of the weight loss of Alloy 706. Although the observed crevice corrosion was somewhat worse for the 3 Sn alloy than for Alloy 706, such corrosion was not severe. The observed localized corrosion for the 1 Sn alloy and Alloy 706 was, in the terms utilized in this sense, essentially equivalent.

EXAMPLE IV

Figure 3:
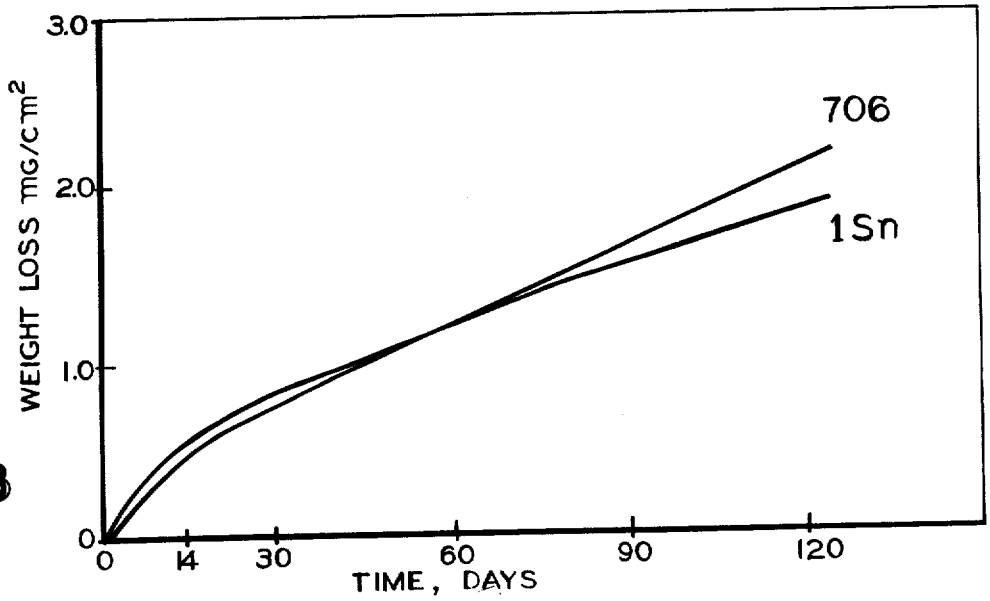
FIG. 3 is a graph comparing the weight loss in artificial cooling tower water of an alloy system of the present invention when compared to Alloy 706.

Strips of the 1 Sn alloy and Alloy 706 were placed in a trough similar to that used in Examples I and II. This trough contained a solution which approximated cooling tower water and the various constituents of this solution are shown in Table II. The solution was recirculated and changed weekly. The weight loss data for the cooling water trough test is shown in FIG. 3.

TABLE II

ARTIFICIAL COOLING TOWER WATER

| Constituent | Parts Per Million (ppm) | $CaCO_3$ Equivalent |
|---|---|---|
| Cations | | |
| Calcium ($Ca^{++}$) | 400 | 1000 |
| Magnesium ($Mg^{++}$) | 100 | 410 |
| Sodium ($Na^{+}$) | 239 | 522 |
| Potassium ($K^{+}$) | 25.7 | 32.3 |
| Anions | | |

TABLE II-continued

| ARTIFICIAL COOLING TOWER WATER | | |
|---|---|---|
| Constituent | Parts Per Million (ppm) | $CaCO_3$ Equivalent |
| Bicarbonate ($HCO_3^-$) | — | 12 |
| Carbonate ($CO_3^=$) | — | 0 |
| Hydroxide ($OH^-$) | — | 0 |
| Sulfate ($SO_4^=$) | 1950 | 2030 |
| Chloride ($Cl^-$) | 410 | 578 |
| Nitrate ($NO_3^-$) | 10.34 | 8.4 |
| Total Hardness ($CaCO_3$) | — | 1410 |
| Carbon Dioxide ($CO_2$) | 7.5 | — |
| Silica ($SiO_2$) | 16.6 | — |
| Iron (Fe) | < .1 | — |
| Copper (Cu) | < .1 | — |
| Zinc (Zn) | < .1 | — |
| Aluminum (Al) | < .25 | — |
| Nickel (Ni) | < .1 | — |
| Chromium (Cr) | < .05 | — |
| Cobalt (Co) | < .1 | — |
| Total Dissolved Solids | 3902 | — |
| Turbidity (JTU) | < .01 | — |
| Suspended Solids | 5 | — |

Temperature = 40° C., pH = 6.5, pHs = 7.4, Langelier Index = −.9, Chemical Oxygen Demand = 10.5.

It can be seen from FIG. 3 that the 1 Sn alloy has essentially an equivalent corrosion rate, both initially and long term, to the corrosion rate of Alloy 706.

As can be seen from these examples, the alloy system of the present invention provides equivalent or greater corrosion resistance results than commercial Alloy 706 in potable water, brackish water and cooling tower water testing. This alloy system is intended as a lower cost replacement for Alloy 706 generally in various water applications. At present, Alloy 706 is not economically competitive with such materials as 304 stainless steels. Reduction of the nickel content and thus reduction of the cost brought about by the alloy system of the present invention without sacrificing corrosion resistance properties produces an alloy with more favorable economics to those contemplating the use of copper alloys in tubing applications. The alloy of the present invention may also be utilized in various other applications, such as those applications which use the material for its strength properties or those which use the material for its pleasing appearance. For example, the alloy of the present invention may be useful as construction material and may also be useful in furniture or decorative applications. Various other uses of this alloy system will depend upon the particular property or properties desired by the fabricator in the final product.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A corrosion resistant single phase alloy which is particularly useful in tubing applications, said alloy being free of aluminum, said alloy having an improved steady state corrosion rate, said alloy consisting essentially of 3.0 to 7.5% by weight nickel, 0.5 to 4.0% by weight tin and 0.001 to 1.0% by weight manganese, balance copper.

2. An alloy according to claim 1 further consisting essentially of 0.01 to 2.0% by weight of an element selected from the group consisting of arsenic, antimony and phosphorus or combinations thereof.

3. An alloy according to claim 1 wherein the elements present in said alloy consist essentially of 4.0 to 6.0% by weight nickel, 1.0 to 3.0% by weight tin, 0.1 to 0.5% by weight manganese, balance copper.

4. A corrosion resistant single phase alloy which is particularly useful in tubing applications, wherein the elements present in said alloy consist essentially of 3.0 to 7.5% by weight nickel, 0.5 to 4% by weight tin, up to 4% by weight aluminum, 0.001 to 1.0% by weight manganese, and 0.01 to 2.0% by weight of an element selected from the group consisting of arsenic and antimony or combinations thereof, the balance copper.

5. An alloy according to claim 4 wherein the elements present in said alloy consist essentially of 4.0 to 6.0% by weight nickel, 2.0 to 3.0% by weight aluminum, 1.0 to 3.0% by weight tin, 0.1 to 0.5% by weight manganese, balance copper.

* * * * *